US006575787B2

(12) United States Patent
Ishikawa et al.

(10) Patent No.: US 6,575,787 B2
(45) Date of Patent: Jun. 10, 2003

(54) WATERPROOF CONNECTOR WITH COVER HAVING TUBULAR PORTION

(75) Inventors: Ryotaro Ishikawa, Yokkaichi (JP); Hajime Kawase, Yokkaichi (JP); Yuuichi Nankou, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/997,015

(22) Filed: Nov. 30, 2001

(65) Prior Publication Data

US 2002/0076980 A1 Jun. 20, 2002

(30) Foreign Application Priority Data

Dec. 18, 2000 (JP) ..... 2000-383680

(51) Int. Cl.[7] ..... H01R 13/40

(52) U.S. Cl. ..... 439/587; 434/34; 434/364; 434/559; 434/89; 434/278; 434/76.2; 434/949

(58) Field of Search ..... 439/587, 364, 439/559, 34, 278, 89, 281, 283, 76.1, 76.2, 949

(56) References Cited

U.S. PATENT DOCUMENTS 5,486,119 A 1/1996 Nabeshima et al.
5,639,257 A * 6/1997 Yamaguchi et al. ..... 439/364
5,820,401 A * 10/1998 Hasz et al. ..... 439/364
5,836,787 A * 11/1998 Kodama ..... 439/567
6,050,839 A * 4/2000 Seminara et al. ..... 439/364

* cited by examiner

*Primary Examiner*—P. Austin Bradley
*Assistant Examiner*—Truc Nguyen
(74) *Attorney, Agent, or Firm*—Banner & Witcoff, Ltd.

(57) ABSTRACT

The invention provides a waterproof connector in which a seal is maintained around a bolt without having to increase the number of components. A bolt 39 is passed through a through hole 36 of a bolt attachment member 35, this bolt 39 being passed from a countersunk hole 46 of a grommet 40 attached so as to cover a posterior face of a female housing 30. A nut 26 of a male housing 20 is fastened to this bolt 39, this fastening the two housings 20 and 30 together. A circular sealing member 50 is formed in a manner whereby it adjoins a central hole 47 of a base face 46A of the countersunk hole 46, a shaft 39A of the bolt 39 passing through this sealing member 50 in a manner whereby it fits tightly therewith. The sealing member 50 fits into a housing hole 53 of the bolt attachment member 35. If electric wires are pulled so as to cause a tubular member 45 to change shape, the base face 46A of the countersunk hole 46 may receive a pulling force which causes it to change shape and move outwards relative to the direction of its diameter. However, the adjoining sealing member 50 has been fitted into the housing hole 53, thus preventing the sealing member 50 from changing shape. Consequently, a seal is reliably maintained around the shaft 39A of the bolt 39.

15 Claims, 3 Drawing Sheets

WATERPROOF CONNECTOR WITH COVER HAVING TUBULAR PORTION

TECHNICAL FIELD

The present invention relates to the improvement of a waterproof connector that is covered by a grommet and fixed by a bolt to a corresponding housing.

BACKGROUND TO THE INVENTION

One example of this type of waterproof connector is a connector attached to a panel, as described in JP 6-72177. As shown in FIG. 5 of this specification, this waterproof connector has a male housing 2 attached, in a waiting state, to a panel 1 via an attachment hole 1A of this panel 1. A waterproof female housing 3 is fitted to this male housing 2. A posterior face of the female housing 3 is covered by a grommet 4 which makes contact with hole edges of the attachment hole 1A, thereby sealing the attachment hole 1A. Furthermore, the grommet 4 is provided with a tubular member 4A that leads a bundle of electric wires in a specified direction. The grommet 4 is passed through the female housing 3, then a bolt 5 is attached thereto. A nut 6 attached to the male housing 2 is screwed to the bolt 5, thus fastening the two housings 2 and 3 together.

In this type of connector, if the electric wires that have been led outwards have a pulling force exerted thereon such that the tubular member 4A changes shape in either of the directions shown by the arrows in FIG. 5, this change of shape may affect an inserted portion 7 of the bolt 5, (i.e., the portion of the bolt 5 passing through the grommet 4). A space may appear between the grommet 4 and the inserted portion 7, thus damaging the seal around the bolt 5. Conventionally, this problem has been dealt with by covering the exterior of the grommet 4 with a rigid plastic cover 8, this pushing down on the grommet 4 since the two are fastened together. This cover 8 prevents the inserted portion 7 etc. of the bolt 5 from changing shape as a result of the grommet 4 changing shape.

Since the conventional connector requires an extra component, namely, the cover 8, the number of components increases, and production costs increase commensurately. The present invention has taken the above problem into consideration, and aims to present a waterproof connector in which the seal is maintained around the bolt without having to increase the number of components.

SUMMARY OF THE INVENTION

According to the invention there is provided a waterproof connector comprising a first housing engageable with a second housing, and a screw-threaded bolt operable between the housings to fasten the housings together, one of said housings having a resilient waterproofing cover, and an aperture in the cover to resiliently receive the shaft of said bolt, characterized in that said cover includes a tubular portion to receive said shaft, at least part of said tubular portion being housed in a corresponding recess of said one of said housings, and in use said cover being gripped between the head of said bolt and said one of said housings.

Such an arrangement ensures that the tubular portion of the cover grips the shaft of the bolt despite movement of wires which exit from the cover.

Preferably a recess is provided on the inside surface of the cover and for engagement with a tubular bolt receiving projection of the housing. Such an arrangement enhances sealing.

Preferably the projection engages closely with the rim defining this recess, and in the preferred embodiment the projection has an edge for engaging the inside surface of the cover. This edge is preferable triangular in section and engages with a recess of mating form. In the preferred embodiment the recess and projection are circular and concentric.

BRIEF DESCRIPTION OF DRAWINGS

Other features of the invention will be apparent from the following description of a preferred embodiment shown by way of example only in the accompanying drawings, in which.

DESCRIPTION OF PREFERRED EMBODIMENT

An embodiment of the present invention is described below with the aid of FIGS. 1 to 4.

Figure 1:
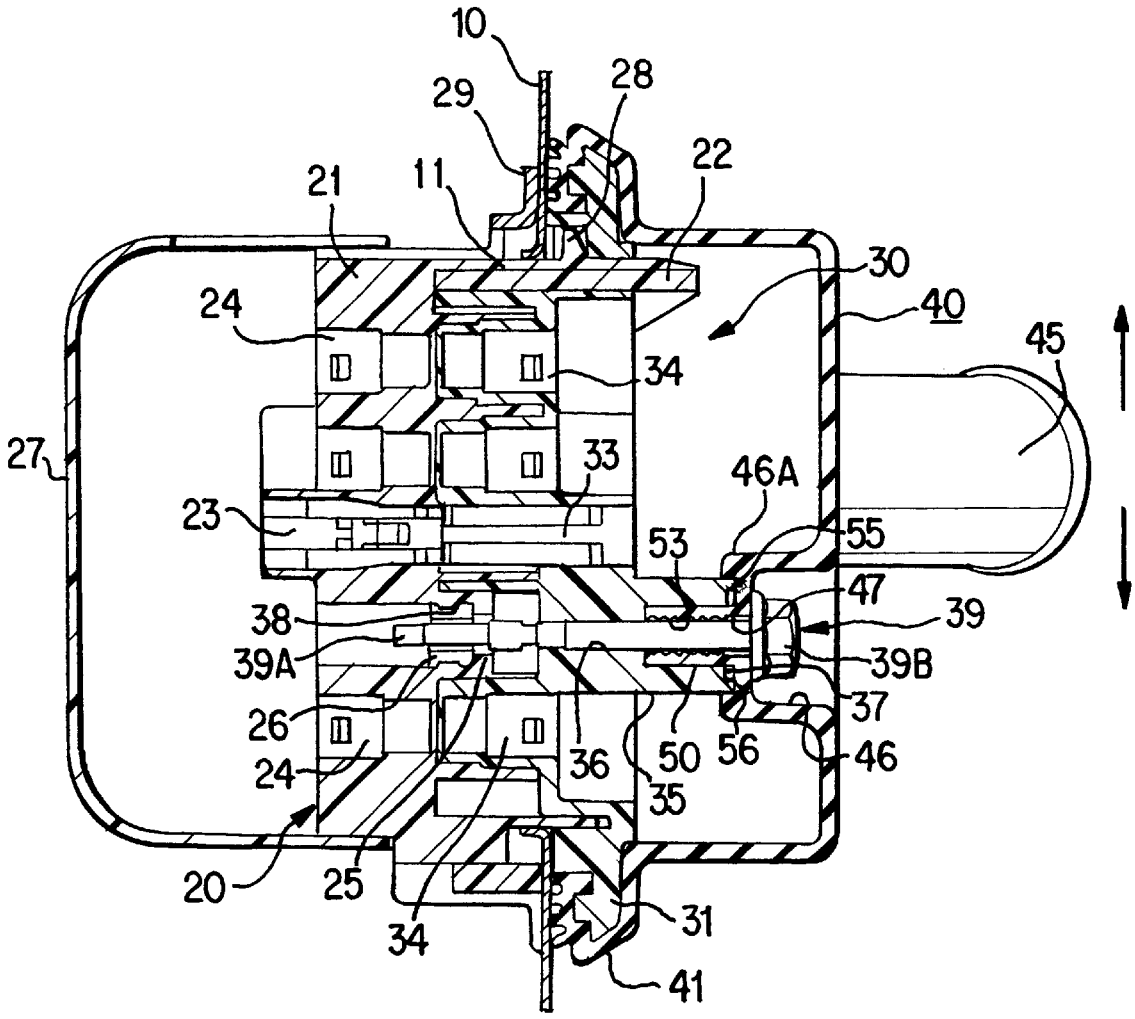
FIG. 1 is a cross-sectional view of an embodiment of the present invention.
Figure 3:
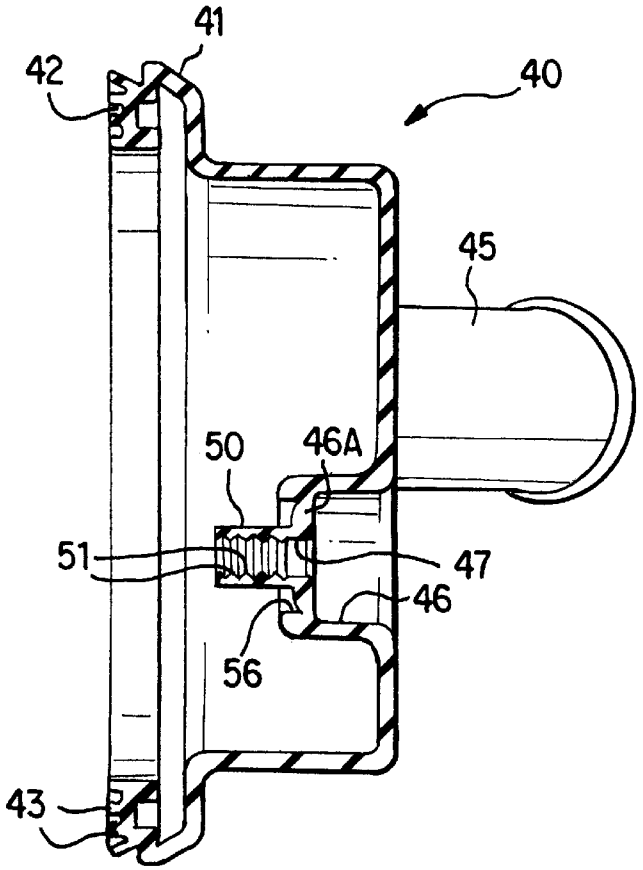
FIG. 3 is a cross-sectional view of the grommet.
Figure 2:
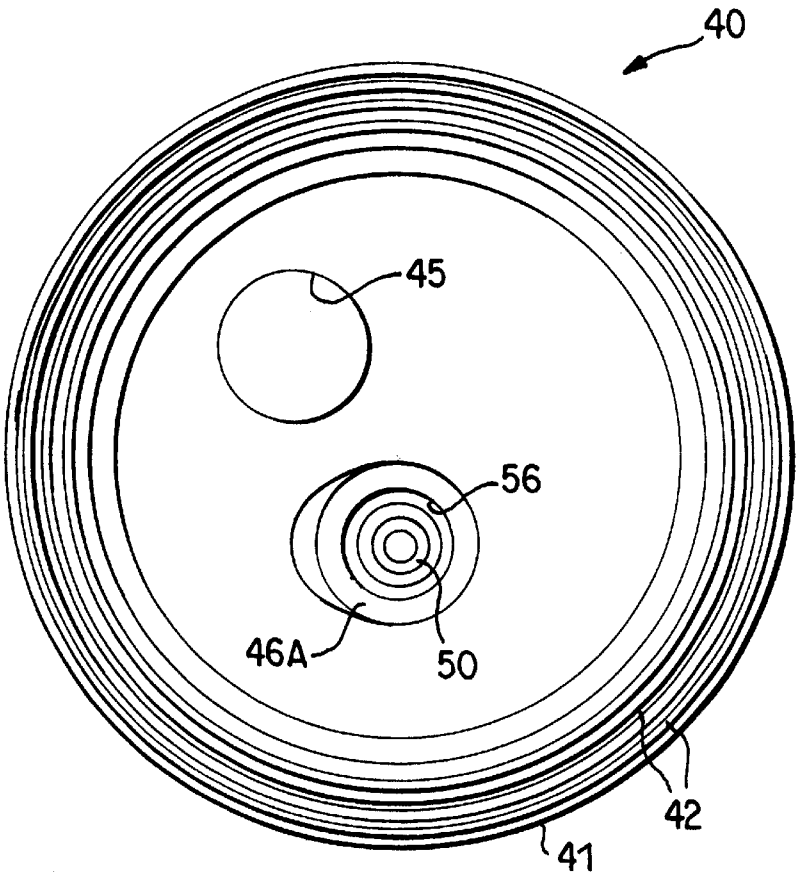
FIG. 2 is a front view of a grommet.
Figure 5:
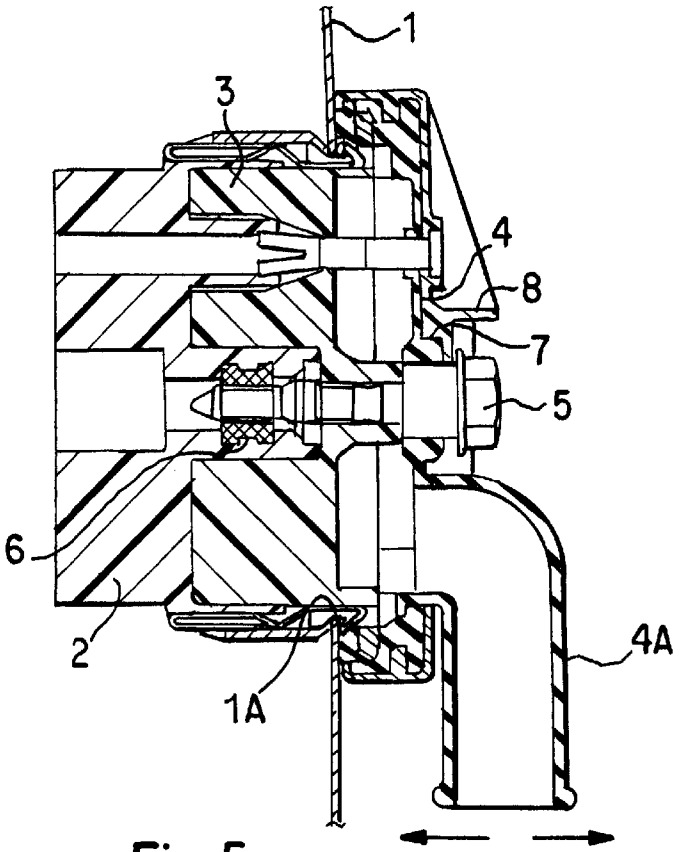
Fig. 5 PRIOR ART
FIG. 5 is a cross-sectional view of a prior art example.
Figure 4:
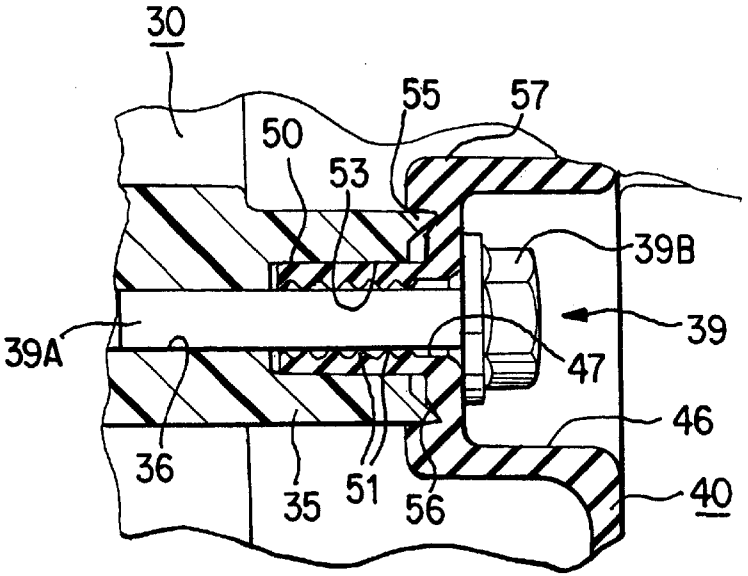
FIG. 4 is an enlarged cross-sectional view showing the vicinity of attaching portions of a sealing member of the grommet.

As shown in FIG. 1, the present embodiment relates to a connector attached to a panel, wherein a male connector housing 20 (hereafter referred to as male housing) is attached from its innermost side to a panel 10 via a circular attachment hole 11 opening therein, being attached thereto in a waiting state. A waterproof female connector housing 30 of the present invention (hereafter referred to as female housing) can be fitted to the male housing 20 from the outermost side thereof. The two are then fastened together by a bolt 39.

In the following description, fitting face sides of the two housings 20 and 30 are referred to as the anterior sides.

The male housing 20 is made from plastic, and has a cylindrical hood 22 provided at an anterior face of a thick disc-like main body 21 thereof. This hood 22 fits tightly into the attachment hole 11 of the panel 10. The main body 21 is provided with attaching holes 24 and cavities 23 for housing large male terminal fittings. Sub-housings which house small male terminal fittings are attached within the attaching holes 24.

A fastening member 25 is provided at a specified location on an anterior face of the male housing 20, being located close to the centre thereof. A nut 26 is embedded in this fastening member 25. This nut 26 is screwed to the bolt 39 attached to the corresponding female housing 30.

A cover 27 is attached to a posterior face of the male housing 20, this cover 27 gathering together and housing a bundle of electric wires that are led out from the male housing 20, and leading these electric wires outwards in a specified direction. An outer circumference face of an anterior end of the hood 22 is provided with retaining claws 28 and a contacting rim 29. These engage, respectively, with one side and the other side of a hole edge of the attachment hole 11, thereby attaching the male housing 20, in a waiting state, to the attachment hole 11.

The female housing 30 is also made from plastic. It is shaped like a thick disc and is capable of fitting into the hood 22 of the male housing 20. A flange 31 is formed along an outer circumference face of a posterior end thereof. This flange 31 corresponds to the hole edge of the attachment hole 11.

The female housing 30 is provided with cavities 33, for housing large female terminal fittings, and attaching holes 34; within these attaching holes 34 are attached sub-connectors which house small female terminal fittings.

A bolt attachment member 35 is provided on the female housing 30 at a location corresponding to the fastening member 25 of the male housing 20. The bolt attachment member 35 is pillar-like and protrudes at a posterior face of the female housing 30. A through hole 36 is formed in the centre of this bolt attachment member 35, a shaft 39A of the bolt 39 being passed through this through hole 36. A face of the bolt attachment member 35 that protrudes to the posterior forms a receiving face 37 which receives a head 39B of the bolt 39. Furthermore, a fitting hole 38 is formed in an anterior end face of the bolt attachment member 35. This fits with an outer circumference of the fastening member 25 of the male housing 20.

The posterior face of the female housing 30 is covered by a grommet 40. This grommet 40 (shown in FIGS. 2 and 3) is made from rubber. In its entirety it is shaped like a cylinder with a base and is formed so as to cover, from an outer circumference of the flange 31, the posterior face of the female housing 30. A hole edge of this grommet 40 is provided with a groove-shaped fitting member 41 which fits with an outer circumference edge of the flange 31, thereby attaching the grommet 40 to the female housing 30. An anterior face of the fitting member 41 is a contacting face 42 which makes contact with the hole edge of the attachment hole 11. A plurality of lips 43 are provided concentrically in this contacting face 42.

A tubular member 45 protrudes in an inclined manner from a posterior face of the grommet 40. A bundle of electric wires that are led out from a posterior face of the female housing 30 are gathered together within the grommet 40, and then are led outwards in a specified direction by the tubular member 45.

Further, a countersunk hole 46 is formed in the posterior face of the grommet 40 at a location corresponding to the bolt attachment member 35. A central hole 47, through which the shaft 39A of the bolt 39 can be passed, opens into a base face 46A of this countersunk hole 46. The head 39B of the bolt 39 is housed within the countersunk hole 46 in a manner whereby this bolt 39 can be rotated by a tool.

A cylindrical sealing member 50 is formed in an unified manner from a hole edge of an outer side (the left side in FIG. 3) of the central hole 47 in the base face 46A of the countersunk hole 46 of the grommet 40. The shaft 39A of the bolt 39 fits tightly within this sealing member 50. More specifically, a portion of a specified length at the base of the shaft 39A fits within this sealing member 50. A plurality of lips 51 are formed in an inner circumference face of the sealing member 50, these having spaces formed therebetween which extend along the axial direction of the sealing member 50. As shown in detail in FIG. 4, along the end of the bolt attachment member 35 that is provided with the receiving face 37, the bolt attachment member 35 is wider in diameter than the through hole 36. This wider portion forms a housing hole 53 into which the sealing member 50 can be fitted tightly.

Moreover, an engaging protrusion 55, which has a cross-sectional peak shape, is formed along the entire circumference of a circumference edge of the receiving face 37 of the bolt attachment member 35. A circular circumference groove 56 is formed on the base face 46A of the countersunk hole 46 of the grommet 40. A tip end portion of the engaging protrusion 55 fits into this circular circumference groove 56 which is bounded by an upstanding annular wall 57.

Next, the operation of the present embodiment will be described.

The male terminal fittings and the sub-connectors are attached within the main body 21 of the male housing 20, and the cover 27 is attached to the posterior face of the male housing 20. The male housing 20 is inserted into the attachment hole 11 of the panel 10 from an inner side thereof, the male housing 20 being attached to this panel 10 in a waiting state.

In the same manner, the female terminal fittings and the sub-connectors are attached within the female housing 30, and the grommet 40 is attached to the posterior face of the female housing 30. At this juncture, the sealing member 50 of the grommet 40 is pushed into the housing hole 53 of the bolt attachment member 35.

Next, the bolt 39 is attached to the female housing 30. The shaft 39A of the bolt 39 is inserted through the central hole 47 of the countersunk hole 46 of the grommet 40. After the shaft 39A has passed through the sealing member 50, it is passed through the through hole 36 of the bolt attachment member 35 and protrudes into the fitting hole 38, the head 39B being housed within the countersunk hole 46. The bundle of electric wires which extend outwards (in a state whereby they have been gathered together) from the posterior face of the female housing 30 are passed through the tubular member 45 of the grommet 40 and are thereby led in a specified direction.

The female housing 30, which has been assembled in this manner and to which the bolt 39 is attached in a location whereby this bolt 39 will fit with the fastening member 25, is fitted into the hood 22 of the male housing 20 from the outermost side of this male housing 20. When a tip of the shaft 39A of the bolt 39 has entered the nut 26 located in the fastening member 25, the fitting operation is temporarily halted.

Next, a tool is inserted into the countersunk hole 46 of the grommet 40, this tool being used to rotate the bolt 39. A male screw portion of the bolt 39 is screwed into the nut 26, this gradually drawing the female housing 30 into the hood 22. When the female housing 30 has been drawn inwards to a location whereby its anterior face strikes against an innermost face of the hood 22, the rotation of the bolt 39 is halted, and the male and female housings 20 and 30 are maintained in a correctly fitted state.

At this juncture, the contacting face 42 of the fitting member 41 of the grommet 40 is pushed against the hole edge of the attachment hole 11, the lips 43 of this contacting face 42 contracting resiliently. By this means, a seal is formed around the attachment hole 11. Moreover, the base face 46A of the countersunk hole 46 of the grommet 40 is gripped between the head 39B of the bolt 39 and the receiving face 37 of the bolt attachment member 35, this sealing the inserted portion of the shaft 39A of the bolt 39. Further, the engaging protrusion 55 of the receiving face 37 is in a state whereby it fits into the circular circumference groove 56 of the base face 46A of the countersunk hole 46.

After the attachment has been completed in the manner described above and the connector is in use, a pulling force may be exerted on the bundle of electric wires that are led outwards from the female housing 30, this exerting a force on the tubular member 45 of the grommet 40 and thereby causing it to change shape and move in either of the directions shown by the arrows in FIG. 1. Consequently, the base face 46A of the countersunk hole 46 receives a pulling force which moves it outwards relative to the direction of its diameter, and a space may appear between this base face 46A and the shaft 39A of the bolt 39.

However, the engaging protrusion 55, which protrudes from the receiving face 37, fits into the area surrounding the central hole 47 of the base face 46A of the countersunk hole 46. This prevents the base face 46A of the countersunk hole 46 from changing shape as a result of being pulled.

A pulling force may be exerted so as to move the other face of the base face 46A (i.e., the face thereof which does not have the engaging protrusion 55 fitting therewith). However, the sealing member 50 has been fitted into the housing hole 53 of the receiving face 37 of the bolt attachment member 35, this preventing the sealing member 50 from changing shape as a result of being pulled. The sealing member 50 is maintained in a state whereby, with the lips 51 thereof being resiliently compressed, it fits tightly with the outer circumference of the shaft 39A of the bolt 39. In this manner, a seal is reliably maintained around the shaft 39A of the bolt 39.

In the embodiment described above, a seal is maintained around the inserted portion of the bolt 39 without this requiring a separate component for pushing down the grommet 40. Consequently, the number of components is reduced, and production costs are also reduced.

Furthermore, the engaging protrusion 55 of the receiving face 37 (which is opposite the grommet 40) fits into the area surrounding the central hole 47 of the base face 46A of the countersunk hole 46 of this grommet 40. Consequently, the base face 46A of the countersunk hole 46 does not change shape as a result of being pulled, and the seal thereof is improved.

The present invention is not limited to the embodiments described above with the aid of figures. For example, the possibilities described below also lie within the technical range of the present invention. In addition, the present invention may be embodied in various other ways without deviating from the scope thereof.

(1) The present invention is equally suitable for a case whereby the female housing is attached in a waiting state and the male housing is waterproof, i.e., the inverse case of the present embodiment.

(2) The present invention is not applicable only to a connector attached to a panel. It may also be made suitable for all waterproof connectors which are covered by a grommet and which are fastened to a corresponding housing by a bolt.

What is claimed is:

1. A waterproof connector comprising a first housing engagable with a second housing in a fitting direction, and a screw-threaded bolt operable between the housings to fasten the housings together, one of said housings having a resilient waterproofing cover, and an aperture in the cover to resiliently receive a shaft of said bolt, wherein said cover includes a resilient elongated tubular portion of one-piece construction with said cover to receive said shaft, at least part of said elongated tubular portion extending into and tightly fitted with a corresponding recess of said one of said housings, and in use said cover being gripped between a head of said bolt and said one of said housings.

2. A connector according to claim 1 wherein said cover includes a depression, the head of said bolt being housed in said depression.

3. A connector according to claim 1 wherein said recess is cylindrical.

4. A connector according to claim 2 wherein said recess is cylindrical.

5. A connector according to claim 1 wherein said one of said housings includes an upstanding rim surrounding said recess and for engagement with said cover, wherein said rim extends in said fitting direction.

6. A connector according to claim 5 wherein said upstanding rim tapers to an edge.

7. A connector according to claim 5 wherein said cover includes an upstanding annular portion surrounding said tubular portion at a distance, said upstanding rim engaging within said annular portion.

8. A connector according to claim 6 wherein said cover includes an upstanding annular portion surrounding said tubular portion at a distance, said upstanding rim engaging within said annular portion.

9. A connector according to claim 7 wherein said annular portion and upstanding rim are circular and concentric.

10. A connector according to claim 8 wherein said annular portion and upstanding rim are circular and concentric.

11. A connector according to claim 5 wherein a diameter of the head of said bolt is less than an outer diameter of said upstanding rim.

12. A connector according to claim 6 wherein a diameter of the head of said bolt is less than an outer diameter of said upstanding rim.

13. A connector according to claim 7 wherein a diameter of the head of said bolt is less than an outer diameter of said upstanding rim.

14. A connector according to claim 1 wherein said tubular portion is substantially within said recess in use.

15. A connector according to claim 14 wherein said tubular portion and recess are circular, the outer diameter of said tubular portion and the internal diameter of said recess are substantially the same, and the internal diameter of said tubular portion has inwardly directed ribs for engagement with said shaft.

* * * * *